US011126098B2

(12) United States Patent
Saito et al.

(10) Patent No.: US 11,126,098 B2
(45) Date of Patent: Sep. 21, 2021

(54) ELECTROSTATIC CHARGE IMAGE DEVELOPMENT TONER, ELECTROSTATIC CHARGE IMAGE DEVELOPER, TONER CARTRIDGE, PROCESS CARTRIDGE, IMAGE FORMING APPARATUS, AND IMAGE FORMING METHOD

(71) Applicant: FUJIFILM Business Innovation Corp., Tokyo (JP)

(72) Inventors: Yutaka Saito, Kanagawa (JP); Daisuke Noguchi, Kanagawa (JP); Sakiko Takeuchi, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/841,661

(22) Filed: Apr. 6, 2020

(65) Prior Publication Data

US 2021/0088920 A1 Mar. 25, 2021

(30) Foreign Application Priority Data

Sep. 19, 2019 (JP) ..... JP2019-170507

(51) Int. Cl.

| | |
|---|---|
| ***G03G 9/08*** | (2006.01) |
| ***G03G 9/113*** | (2006.01) |
| ***G03G 21/18*** | (2006.01) |
| ***G03G 15/08*** | (2006.01) |
| ***G03G 9/097*** | (2006.01) |

(52) U.S. Cl.

CPC ..... *G03G 9/0819* (2013.01); *G03G 9/0821* (2013.01); *G03G 9/09708* (2013.01); *G03G 9/1138* (2013.01); *G03G 9/1139* (2013.01); *G03G 15/0865* (2013.01); *G03G 21/1814* (2013.01)

(58) Field of Classification Search

CPC ..... G03G 9/09708; G03G 9/1138; G03G 9/1139; G03G 9/0819; G03G 9/0821

USPC ..... 430/108.1

See application file for complete search history.

(56) References Cited

U.S. PATENT DOCUMENTS

| | | | | |
|---|---|---|---|---|
| 2005/0255398 | A1* | 11/2005 | Hiraoka | G03G 9/0815 430/109.4 |
| 2008/0227018 | A1* | 9/2008 | Awamura | G03G 9/0827 430/110.4 |
| 2020/0103778 | A1* | 4/2020 | Takabayashi | G03G 9/1133 |

FOREIGN PATENT DOCUMENTS

| | | |
|---|---|---|
| JP | 2006317489 | 11/2006 |
| JP | 2009-237274 | 10/2009 |

* cited by examiner

*Primary Examiner* — Mark A Chapman

(74) *Attorney, Agent, or Firm* — JCIPRNET

(57) ABSTRACT

An electrostatic charge image development toner contains toner particles and layered-structure compound particles. The layered-structure compound particles have a crystallite diameter of 150 Å or more and 250 Å or less as calculated from a maximum peak width in a Cu Kα X-ray diffraction chart and have a number-average particle diameter Dn of 0.3 μm or more and 2.0 μm or less. The ratio Dn/Dv of a number-average particle diameter Dn of the layered-structure compound particles to a volume-average particle diameter Dv of the toner particles is 0.03 or more and 0.7 or less.

19 Claims, 2 Drawing Sheets

ELECTROSTATIC CHARGE IMAGE DEVELOPMENT TONER, ELECTROSTATIC CHARGE IMAGE DEVELOPER, TONER CARTRIDGE, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2019-170507 filed Sep. 19, 2019.

BACKGROUND

(i) Technical Field

The present disclosure relates to an electrostatic charge image development toner, an electrostatic charge image developer, a toner cartridge, a process cartridge, an image forming apparatus, and an image forming method.

(ii) Related Art

Japanese Unexamined Patent Application Publication No. 2006-317489 discloses a toner that contains a base toner having an average circularity of 0.94 to 0.995 and a volume-average particle diameter of 3 μm to 9 μm and a melamine cyanurate powder having a volume-average particle diameter of 3 μm to 9 μm, wherein the melamine cyanurate powder is present in an amount of 0.1 to 2.0 parts by weight relative to 100 parts by weight of the base toner.

Japanese Unexamined Patent Application Publication No. 2009-237274 discloses a positively chargeable toner that contains colored resin particles containing a binder resin, a coloring agent, and a positive charge controlling agent, and melamine cyanurate particles having a number-average primary particle diameter of 0.05 μm to 1.5 μm, wherein the melamine cyanurate particles are present in an amount of 0.01 to 0.5 parts by weight relative to 100 parts by weight of the colored resin particles.

SUMMARY

Aspects of non-limiting embodiments of the present disclosure relate to an electrostatic charge image development toner that is unlikely to generate color streaks caused by toner or external additives passing through a cleaning blade of an intermediate transfer body compared with an electrostatic charge image development toner containing toner particles and layered-structure compound particles, wherein the layered-structure compound particles have a crystallite diameter of less than 150 Å or more than 250 Å, the layered-structure compound particles have a number-average particle diameter Dn of less than 0.3 μm or more than 2.0 μm, or the ratio Dn/Dv of the number-average particle diameter Dn of the layered-structure compound particles to the volume-average particle diameter Dv of the toner particles is less than 0.03 or more than 0.7.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an electrostatic charge image development toner containing toner particles and layered-structure compound particles. The layered-structure compound particles have a crystallite diameter of 150 Å or more and 250 Å or less as calculated from a maximum peak width in a Cu Kα X-ray diffraction chart and have a number-average particle diameter Dn of 0.3 μm or more and 2.0 μm or less. The ratio Dn/Dv of the number-average particle diameter Dn of the layered-structure compound particles to the volume-average particle diameter Dv of the toner particles is 0.03 or more and 0.7 or less.

BRIEF DESCRIPTION OF THE DRAWINGS

Exemplary embodiments of the present disclosure will be described in detail based on the following figures, wherein.

DETAILED DESCRIPTION

Figure 1:
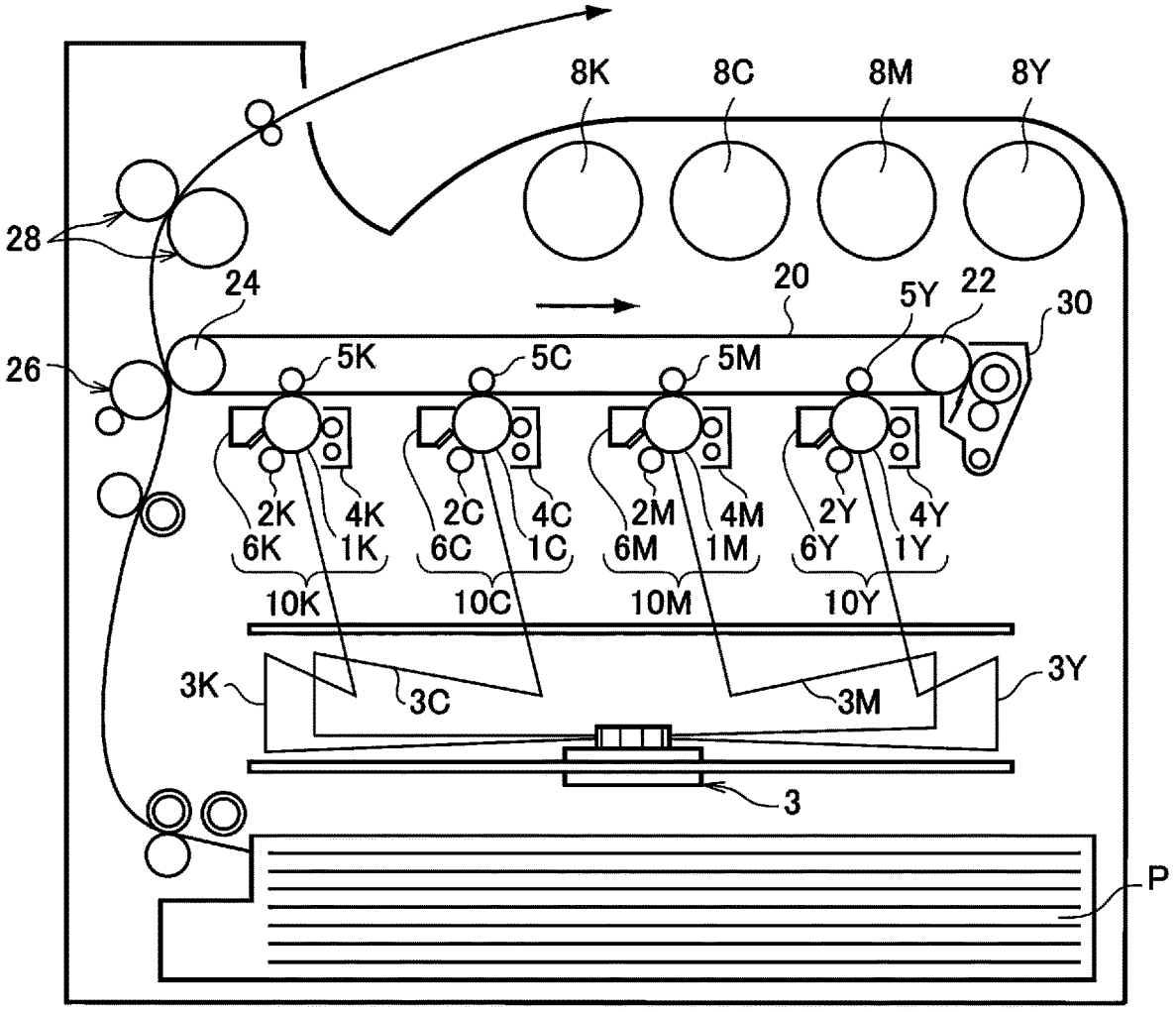
FIG. 1 is a schematic structural view of an example of an image forming apparatus according to an exemplary embodiment.

Exemplary embodiments of the present disclosure will be described below. The following description and Examples are provided to illustrate exemplary embodiments but are not intended to limit the scope of the exemplary embodiments.

The numerical ranges expressed by using "to" in the present disclosure denote ranges including the numerical values before and after "to" as the minimum value and the maximum value.

The upper limit or the lower limit of one numerical range in stepwise numerical ranges in the present disclosure may be replaced by the upper limit or the lower limit of another stepwise numerical range. The upper limit or the lower limit of any numerical range described in the present disclosure may be replaced by the values described in Examples.

In the present disclosure, the term "step" not only includes an independent step but also includes a step that cannot be clearly distinguished from other steps but may accomplish an intended purpose.

In the description of exemplary embodiments with reference to the drawings in the present disclosure, the structures of the exemplary embodiments are not limited to the structures shown in the drawings. The sizes of the members in each of the drawings are conceptual sizes, and the relative relationship between the sizes of the members is not limited to that shown in the drawings.

In the present disclosure, each component may contain multiple corresponding substances. In the present disclosure, the amount of each component in a composition refers to, when there are multiple substances corresponding to each component in the composition, the total amount of the substances present in the composition, unless otherwise specified.

In the present disclosure, each component may contain multiple types of particles corresponding to each component. The particle diameter of each component refers to, when there are multiple types of particles corresponding to each component in the composition, the particle diameter of a mixture of the multiple types of particles present in the composition, unless otherwise specified.

In the present disclosure, the "electrostatic charge image development toner" is also referred to simply as "toner", and the "electrostatic charge image developer" is also referred to simply as a "developer."

Electrostatic Charge Image Development Toner

A toner according to an exemplary embodiment contains toner particles and layered-structure compound particles. The layered-structure compound particles have a crystallite diameter of 150 Å or more and 250 Å or less and has a number-average particle diameter Dn of 0.3 μm or more and 2.0 μm or less. The ratio Dn/Dv of the number-average particle diameter Dn of the layered-structure compound particles to the volume-average particle diameter Dv of the toner particles is 0.03 or more and 0.7 or less.

The toner according to the exemplary embodiment is unlikely to generate color streaks caused by toner or external additives passing through a cleaning blade of an intermediate transfer body. The mechanism for this may be as described below.

Toner having layered-structure compound particles (e.g., melamine cyanurate particles, boron nitride particles) as an external additive is known in the related art. Layered-structure compound particles are particles of a compound having a layered structure with an interlayer distance in the order of angstroms. The layers may move relative to each other to exhibit a lubrication effect. The layered-structure compound particles externally added to the toner partially function as a lubricant in a contact region between an image holding member and a cleaning blade, and the layered-structure compound particles partially function as a lubricant in a contact region between an intermediate transfer body and a cleaning blade.

By the way, the intermediate transfer body is a member having high smoothness and low coefficient of friction. To sufficiently clean the intermediate transfer body, a relatively high pressure is applied to the cleaning blade. Thus, the layered-structure compound particles are compressed against each other to form aggregates of the layered-structure compound particles in a contact region between the intermediate transfer body and the cleaning blade. The aggregates of the layered-structure compound particles do not exhibit lubrication performance and thus the toner or external additives (including aggregates of the layered-structure compound particles) may pass through the cleaning blade to generate color streaks in images. In particular, under the conditions where high-density images are continuously formed for a long time, a relatively large amount of the layered-structure compound particles is supplied to a contact region between the intermediate transfer body and the cleaning blade. This may tend to form aggregates of the intermediate transfer body. As a result, a large amount of aggregates may pass through the cleaning blade, and color streaks may be more likely to form.

When the crystallite diameter and the particle diameter of the layered-structure compound particles are in suitable ranges and when the ratio of the particle diameter of the layered-structure compound particles to the particle diameter of the toner particles is in a suitable range, the layered-structure compound particles may more effectively exhibit a lubrication effect in a contact region between the intermediate transfer body and the cleaning blade. This may prevent generation of color streaks.

If the layered-structure compound particles have a crystallite diameter of less than 150 Å or more than 250 Å, the layers are unlikely to move relative to each other, and the lubrication effect of each layered-structure compound particle may be insufficient. To improve the lubrication effect of each layered-structure compound particle, the crystallite diameter of the layered-structure compound particles is 150 Å or more and 250 Å or less, preferably 160 Å or more and 250 Å or less, more preferably 170 Å or more and 250 Å or less, and still more preferably 180 Å or more and 250 Å or less.

If the layered-structure compound particles have a number-average particle diameter Dn of less than 0.3 μm, the distance by which the layers move relative to each other may be short, and the lubrication effect of each layered-structure compound particle may be insufficient. To improve the lubrication effect of each layered-structure compound particle, the number-average particle diameter Dn of the layered-structure compound particles is 0.3 μm or more, preferably 0.5 μm or more, and more preferably 0.7 μm or more.

If the layered-structure compound particles have a number-average particle diameter Dn of more than 2.0 μm, the layered-structure compound particles may easily be detached from the toner particle surface, and many layered-structure compound particles may remain on the image holding member, so that a small amount of the layered-structure compound particles may be supplied onto the intermediate transfer body. To supply the layered-structure compound particles onto the intermediate transfer body, the number-average particle diameter Dn of the layered-structure compound particles is 2.0 μm or less, preferably 1.8 μm or less, more preferably 1.7 μm or less, and still more preferably 1.5 μm or less.

If the ratio Dn/Dv of the number-average particle diameter Dn of the layered-structure compound particles to the volume-average particle diameter Dv of the toner particles is less than 0.03, the layered-structure compound particles are too small relative to the toner particles, and the layered-structure compound particles may be buried in the toner particle surface, so that the layered-structure compound particles may be unlikely to be supplied onto the intermediate transfer body. To prevent the layered-structure compound particles from being buried in the toner particle surface, the ratio Dn/Dv is 0.03 or more, preferably 0.05 or more, and more preferably 0.1 or more.

If the ratio Dn/Dv of the number-average particle diameter Dn of the layered-structure compound particles to the volume-average particle diameter Dv of the toner particles is more than 0.7, the layered-structure compound particles are too large relative to the toner particles, and the layered-structure compound particles may easily be detached from the toner particle surface, and many layered-structure compound particles may remain on the image holding member, so that a small amount of the layered-structure compound particles may be supplied onto the intermediate transfer body. To supply the layered-structure compound particles onto the intermediate transfer body, the ratio Dn/Dv is 0.7 or less, preferably 0.6 or less, more preferably 0.5 or less, and still more preferably 0.4 or less.

The components, configuration, and features of the toner according to the exemplary embodiment will be described below in detail.

Toner Particles

The toner particles contain, for example, a binder resin and, as necessary, a coloring agent, a release agent, and other additives.

Binder Resin

Examples of the binder resin include vinyl resins composed of a homopolymer of a monomer or a copolymer of two or more monomers of, for example, styrenes (e.g., styrene, p-chlorostyrene, α-methylstyrene), (meth)acrylic acid esters (e.g., methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate), ethylenically unsaturated nitriles (e.g., acrylonitrile, methacrylonitrile), vinyl ethers (e.g., vinyl methyl ether, vinyl isobutyl ether), vinyl ketones (e.g., vinyl methyl ketone, vinyl ethyl ketone, vinyl isopropenyl ketone), and olefins (e.g., ethylene, propylene, butadiene).

Examples of the binder resin include non-vinyl resins, such as epoxy resins, polyester resins, polyurethane resins, polyamide resins, cellulose resins, polyether resins, and modified rosins; and mixtures of these non-vinyl resins and the above vinyl resins, and graft polymers obtained by polymerization of a vinyl monomer in the presence of these non-vinyl resins.

These binder resins may be used alone or in combination of two or more.

The binder resin may be a polyester resin.

Examples of the polyester resin include known amorphous polyester resins. The polyester resin may be a combination of amorphous polyester resin and crystalline polyester resin. The crystalline polyester resin may be used in an amount in a range of 2 mass % or more and 40 mass % or less (preferably 2 mass % or more and 20 mass % or less) relative to the entire binder resin.

The term "crystalline" regarding resin means that the resin shows a distinct endothermic peak rather than stepwise endothermic changes as measured by differential scanning calorimetry (DSC) and specifically means that the half width of the endothermic peak in measuring at a heating rate of 10 (° C./min) is within 10° C.

The term "amorphous" regarding resin means that the resin shows a half width of more than 10° C., shows stepwise endothermic changes, or shows no distinct endothermic peak.

Amorphous Polyester Resin

Examples of the amorphous polyester resin include polycondensation polymers of a polycarboxylic acid and a polyhydric alcohol. The amorphous polyester resin may be a commercial product or a synthetic product.

Examples of the polycarboxylic acid include aliphatic dicarboxylic acids (e.g., oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, naphthalene dicarboxylic acid), anhydrides thereof, and lower (e.g., 1 or more and 5 or less carbon atoms) alkyl esters thereof. Among these, the polycarboxylic acid is preferably, for example, an aromatic dicarboxylic acid.

The polycarboxylic acid may be a combination of a dicarboxylic acid and a trivalent or higher valent carboxylic acid having a crosslinked structure or branched structure. Examples of the trivalent or higher valent carboxylic acid include trimellitic acid, pyromellitic acid, anhydrides thereof, and lower (e.g., 1 or more and 5 or less carbon atoms) alkyl esters thereof.

The polycarboxylic acid may be used alone or in combination of two or more.

Examples of the polyhydric alcohol include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexane dimethanol, hydrogenated bisphenol A), aromatic diols (e.g., an ethylene oxide adduct of bisphenol A, and a propylene oxide adduct of bisphenol A). Among these, the polyhydric alcohol is preferably, for example, an aromatic diol or an alicyclic diol, and more preferably an aromatic diol.

The polyhydric alcohol may be a combination of a diol and a trihydric or higher polyhydric alcohol having a crosslinked structure or branched structure. Examples of the trihydric or higher polyhydric alcohol include glycerol, trimethylolpropane, and pentaerythritol.

The polyhydric alcohol may be used alone or in combination of two or more.

The glass transition temperature (Tg) of the amorphous polyester resin is preferably 50° C. or higher and 80° C. or lower, and more preferably 50° C. or higher and 65° C. or lower.

The glass transition temperature is determined from the DSC curve obtained by differential scanning calorimetry (DSC) and, more specifically, determined in accordance with "extrapolated glass transition onset temperature" described in the method for determining the glass transition temperature in JIS K 7121:1987 "Testing Methods for Transition Temperatures of Plastics".

The weight-average molecular weight (Mw) of the amorphous polyester resin is preferably 5000 or more and 1,000,000 or less, and more preferably 7,000 or more and 500,000 or less.

The number-average molecular weight (Mn) of the amorphous polyester resin is preferably 2,000 or more and 100,000 or less.

The molecular weight distribution Mw/Mn of the amorphous polyester resin is preferably 1.5 or more and 100 or less, and more preferably 2 or more and 60 or less.

The weight-average molecular weight and the number-average molecular weight are determined by gel permeation chromatography (GPC). The determination of the molecular weight by GPC is carried out by using HLC-8120GPC, which is a GPC available from Tosoh Corporation and used as a measurement system, TSKgel SuperHM-M (15 cm), which is a column available from Tosoh Corporation, and a THE solvent. The weight-average molecular weight and the number-average molecular weight are calculated from the molecular weight calibration curve created on the basis of the obtained measurement results using a monodisperse polystyrene standard.

The amorphous polyester resin is produced by using a known manufacturing method. Specifically, the amorphous polyester resin is produced by using a method involving causing reaction at a polymerization temperature of 180° C. or higher and 230° C. or lower in a reaction system, as necessary, under reduced pressure while water and alcohol generated during condensation are removed.

If the monomers serving as raw materials are neither dissolved in nor compatible with each other at a reaction temperature, a solvent with a high boiling point may be added as a solubilizer to form a solution. In this case, the polycondensation reaction is carried out while the solubilizer is distilled off. If a monomer with poor compatibility is present in the copolymerization reaction, the monomer with poor compatibility is previously subjected to condensation with an acid or alcohol that is to undergo polycondensation with the monomer, and the condensate is then subjected to polycondensation with a main component.

Crystalline Polyester Resin

Examples of the crystalline polyester resin include polycondensates of a polycarboxylic acid and a polyhydric alcohol. The crystalline polyester resin may be a commercial product or a synthetic product.

The crystalline polyester resin is preferably a polycondensate produced by using a straight-chain aliphatic polymerizable monomer rather than a polymerizable monomer having an aromatic ring in order to easily form the crystal structure.

Examples of the polycarboxylic acid include aliphatic dicarboxylic acids (e.g., oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid), aromatic dicarboxylic acids (e.g., dibasic acids, such as phthalic acid, isophthalic acid, terephthalic acid, and naphthalene-2,6-dicarboxylic acid), anhydrides thereof, and lower (e.g., 1 or more and 5 or less carbon atoms) alkyl esters thereof.

The polycarboxylic acid may be a combination of a dicarboxylic acid and a trivalent or higher valent carboxylic acid having a crosslinked structure or branched structure. Examples of the trivalent carboxylic acid include aromatic carboxylic acids (e.g., 1,2,3-benzenetricarboxylic acid, 1,2,4-benzenetricarboxylic acid, and 1,2,4-naphthalenetricarboxylic acid), anhydrides thereof, and lower (e.g., 1 or more and 5 or less carbon atoms) alkyl esters thereof.

The polycarboxylic acid may be a combination of these dicarboxylic acids and a dicarboxylic acid having a sulfonic acid group or a dicarboxylic acid having an ethylenic double bond.

The polycarboxylic acid may be used alone or in combination of two or more.

Examples of the polyhydric alcohol include aliphatic diols (e.g., straight-chain aliphatic diols having 7 to 20 carbon atoms in the main chain). Examples of aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosandecanediol. Among these, aliphatic diols are preferably 1,8-octanediol, 1,9-nonanediol, and 1,10-decanediol.

The polyhydric alcohol may be a combination of a diol and a trihydric or higher polyhydric alcohol having a crosslinked structure or branched structure. Examples of the trihydric or higher polyhydric alcohol include glycerol, trimethylolethane, trimethylolpropane, and pentaerythritol.

The polyhydric alcohol may be used alone or in combination of two or more.

The polyhydric alcohol preferably includes 80 mol % or more of an aliphatic diol and more preferably includes 90 mol % or more of an aliphatic diol.

The melting temperature of the crystalline polyester resin is preferably 50° C. or higher and 100° C. or lower, more preferably 55° C. or higher and 90° C. or lower, and still more preferably 60° C. or higher and 85° C. or lower.

The melting temperature is determined from the DSC curve obtained by differential scanning calorimetry (DSC) in accordance with "melting peak temperature" described in the method for determining the melting temperature in JIS K 7121:1987 "Testing Methods for Transition Temperatures of Plastics".

The weight-average molecular weight (Mw) of the crystalline polyester resin is preferably 6,000 or more and 35,000 or less.

The crystalline polyester resin is produced by, for example, a known manufacturing method, like amorphous polyester.

The amount of the binder resin is preferably 40 mass % or more and 95 mass % or less, more preferably 50 mass % or more and 90 mass % or less, and still more preferably 60 mass % or more and 85 mass % or less relative to the entire toner particles.

Coloring Agent

Examples of the coloring agent include pigments, such as carbon black, chrome yellow, hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, rhodamine B lake, lake red C, pigment red, rose bengal, aniline blue, ultramarine blue, calco oil blue, methylene blue chloride, phthalocyanine blue, pigment blue, phthalocyanine green, malachite green oxalate; and dyes, such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

The coloring agent may be used alone or in combination of two or more.

The coloring agent may be a surface-treated coloring agent as necessary and may be used in combination with a dispersant. The coloring agent may be used in combination of two or more.

The amount of the coloring agent is preferably 1 mass % or more and 30 mass % or less, and more preferably 3 mass % or more and 15 mass % or less relative to the entire toner particles.

Release Agent

Examples of the release agent include hydrocarbon waxes; natural waxes, such as carnauba wax, rice wax, and candelilla wax; synthetic or mineral and petroleum waxes, such as montan wax; and ester waxes, such as waxes of fatty acid esters and montanic acid esters. The release agent is not limited to these.

The melting temperature of the release agent is preferably 50° C. or higher and 110° C. or lower, and more preferably 60° C. or higher and 100° C. or lower.

The melting temperature is determined from the DSC curve obtained by differential scanning calorimetry (DSC) in accordance with "melting peak temperature" described in the method for determining the melting temperature in JIS K 7121:1987 "Testing Methods for Transition Temperatures of Plastics".

The amount of the release agent is preferably 1 mass % or more and 20 mass % or less, and more preferably 5 mass % or more and 15 mass % or less relative to the entire toner particles.

Other Additives

Examples of other additives include known additives, such as magnetic substances, charge controlling agents, and inorganic powders. These additives are internal additives and contained in the toner particles.

Properties of Toner Particles and Like

The toner particles may be toner particles having a single-layer structure, or may be toner particles having so-called a core-shell structure including a core part (core particle) and a coating layer (shell layer) covering the core part.

The toner particles having a core-shell structure include, for example, a core part containing a binder resin and as necessary, other additives such as a coloring agent and a release agent; and a coating layer containing a binder resin.

To prevent generation of color streaks caused by failure of cleaning the intermediate transfer body, the volume-average particle diameter Dv of the toner particles is preferably 3.0

μm or more and 10.0 μm or less, more preferably 3.5 μm or more and 7.0 μm or less, and more preferably 4.0 μm or more and 6.0 μm or less.

The volume-average particle diameter Dv of the toner particles is measured by using Coulter Multisizer II (available from Beckman Coulter, Inc.) and an electrolyte ISOTON-II (available from Beckman Coulter, Inc.). Before measurement, 0.5 mg or more and 50 mg or less of a test sample is added to 2 ml of a 5 mass % aqueous solution of a surfactant (e.g., sodium alkylbenzene sulfonate) serving as a dispersant. The mixture is added to 100 ml or more and 150 ml or less of the electrolyte.

The electrolyte in which the sample is suspended is subjected to a dispersion treatment using an ultrasonic disperser for 1 minute, and the particle diameter of particles having a particle diameter in the range of 2 μm or more and 60 μm or less is measured by Coulter Multisizer II with an aperture having a diameter of 100 μm. The number of sampled particles is 50,000. The volume-based cumulative distribution of the particle diameter is drawn from the smaller particle diameter side, and the particle diameter at a cumulative percentage of 50% is defined as a volume-average particle diameter Dv.

The average circularity of the toner particles is preferably 0.94 or more and 1.00 or less, and more preferably 0.95 or more and 0.98 or less.

The average circularity of the toner particles is obtained from (circle equivalent circumference)/(circumference) [circumference of circle having the same projected area as particle image]/(circumference of projected particle image)]. Specifically, the average circularity of the toner particles is a value determined by the following method.

First, the toner particles to be analyzed are collected by suction to form a flat flow, and particle images are captured with stroboscopic flash to obtain still images. The particle images are analyzed with a flow particle image analyzer (FPIA-3000 available from Sysmex Corporation) to determine average circularity. The number of samples used to determine the average circularity is 3,500.

When the toner has external additives, the toner (developer) to be analyzed is dispersed in surfactant-containing water and then subjected to ultrasonication to prepare toner particles having no external additive.

Layered-Structure Compound Particles

The layered-structure compound particles are particles of a compound having a layered structure. Examples of the layered-structure compound particles include melamine cyanurate particles, boron nitride particles, graphite fluoride particles, molybdenum disulfide particles, and mica particles.

To prevent generation of color streaks caused by failure of cleaning the intermediate transfer body, the crystallite diameter of the layered-structure compound particles is preferably 150 Å or more and 250 Å or less, more preferably 160 Å or more and 250 Å or less, more preferably 170 Å or more and 250 Å or less, and still more preferably 180 Å or more and 250 Å or less.

The crystallite diameter of the layered-structure compound particles may be controlled by heating the layered-structure compound particles. Heating is performed, for example, under the conditions of from 50° C. to 400° C. for 10 minutes to 20 minutes. The higher the temperature at which the layered-structure compound particles are heated, the smaller the crystallite diameter. The longer the heating time, the smaller the crystallite diameter.

The crystallite diameter of the layered-structure compound particles is determined in accordance with the Scherrer equation from the maximum peak width in the Cu Kα X-ray diffraction chart.

$$D=K\lambda/(\beta \cos \theta) \qquad \text{Scherrer equation}$$

where D is a crystallite diameter, K is a constant of 0.9, λ is a Cu Kα radiation wavelength of 1.5418 Å, β is a full width at half maximum of the maximum peak, and θ is a Bragg angle (half the diffraction angle 2θ at the maximum peak).

The Cu Kα X-ray diffraction of the layered-structure compound particles is analyzed as described below.

The analysis is performed by using an X-ray diffractometer (e.g., product name: RINT Ultima-III available from Rigaku Corporation), and the analysis conditions are set as follows: radiation source: Cu Kα; voltage: 40 kV; current: 40 mA; sample rotation speed: no rotation; divergence slit: 1.00 mm; divergence longitudinal restriction slit: 10 mm; scattering slit: open; receiving slit: open; scan mode: FT; counting time: 2.0 seconds; step interval: 0.050°; and operation axis: 10.0000° to 70.0000°. In the present disclosure, the half width of a peak in the X-ray diffraction pattern refers to the full width at half maximum.

To prevent generation of color streaks caused by failure of cleaning the intermediate transfer body, the number-average particle diameter Dn of the layered-structure compound particles is 0.3 μm or more and 2.0 μm or less, preferably 0.3 μm or more and 1.8 μm or less, more preferably 0.5 μm or more and 1.8 μm or less, still more preferably 0.5 μm or more and 1.7 μm or less, and yet still more preferably 0.7 μm or more and 1.5 μm or less. The number-average particle diameter of the layered-structure compound particles may be controlled by grinding, sizing, or a combination of grinding and sizing.

The number-average particle diameter Dn of the layered structure compound is determined by the following measurement method:

First, the layered-structure compound particles are separated from the toner. A method for separating the layered-structure compound particles from the toner is not limited. For example, a dispersion in which toner is dispersed in surfactant-containing water is exposed to ultrasonic waves and then subjected to high-speed centrifugation to separate between toner particles, the layered-structure compound particles, and other external additives by virtue of specific gravity. The fraction containing the layered-structure compound particles is extracted and dried to provide layered-structure compound particles.

Next, the layered-structure compound particles are added to an electrolyte aqueous solution (Isoton aqueous solution) and dispersed therein by exposure to ultrasonic waves for 30 seconds or longer. This dispersion is used as a sample, and the particle diameter is measured by using a laser diffraction/scattering particle diameter distribution analyzer (e.g., Microtrac MT3000 II available from MicrotracBEL Corporation). At least 3000 layered-structure compound particles are measured, and the particle diameter at a cumulative percentage of 50% from the smaller particle diameter side in the number-based particle diameter distribution is defined as a number-average particle diameter Dn.

To prevent generation of color streaks caused by failure of cleaning the intermediate transfer body, the amount of the layered-structure compound particles is preferably 0.1 mass % or more and 2.0 mass % or less, more preferably 0.1 mass % or more and 1.0 mass % or less, and still more preferably 0.1 mass % or more and 0.5 mass % or less relative to the entire toner.

External Additives

Examples of external additives include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K2O.(TiO_2)n$, $Al_2O_3.2SiO_2$, $CaCO_3$, $MgCO_3$, $BaSO_4$, and $MgSO_4$.

The surfaces of the inorganic particles serving as an external additive may be hydrophobized. The hydrophobization treatment is performed by, for example, immersing the inorganic particles in a hydrophobizing agent. Examples of the hydrophobizing agent include, but are not limited to, a silane coupling agent, a silicone oil, a titanate coupling agent, and an aluminum coupling agent. These hydrophobizing agents may be used alone or in combination of two or more. The amount of the hydrophobizing agent is normally, for example, 1 part by mass or more and 10 parts by mass or less relative to 100 parts by mass of the inorganic particles.

Examples of external additives also include resin particles (resin particles made of, for example, polystyrene, polymethyl methacrylate, and melamine resin), and cleaning active agents (e.g., higher fatty acid metal salts represented by zinc stearate, particles made of fluorocarbon polymers).

The amount of external additives externally added is, for example, 0.01 mass % or more and 5 mass % or less, and more preferably 0.01 mass % or more and 2.0 mass % or less relative to the toner particles.

Method for Manufacturing Toner

The toner according to the exemplary embodiment is obtained by externally adding external additives to toner particles after the toner particles are manufactured.

The toner particles may be manufactured by using any one of dry manufacturing methods (e.g., kneading-pulverization method) and wet manufacturing methods (e.g., aggregation-coalescence method, suspension-polymerization method, and dissolution-suspension method). The method is not limited to these manufacturing methods, and a known manufacturing method is employed. Among these methods, an aggregation-coalescence method may be used to produce the toner particles.

Specifically, for example, when the toner particles are manufactured by using an aggregation-coalescence method, the toner particles are manufactured through the following steps: a step (resin particle dispersion preparing step) of preparing a resin particle dispersion in which resin particles serving as a binder resin are dispersed; a step (aggregated particle forming step) of aggregating the resin particles (and other particles as necessary) in the resin particle dispersion (in a dispersion obtained by mixing the resin particle dispersion with other particle dispersion as necessary) to form aggregated particles; and a step (fusion-coalescence step) of heating an aggregated particle dispersion in which the aggregated particles are dispersed, causing fusion and coalescence of the aggregated particles to form toner particles.

Each step will be described below in detail.

The following description provides a method for producing toner particles containing a coloring agent and a release agent, but the coloring agent and the release agent are used as necessary. It is understood that additives other than the coloring agent and the release agent may be used.

Resin Particle Dispersion Preparing Step

In addition to a resin particle dispersion in which resin particles serving as a binder resin are dispersed, for example, a coloring agent particle dispersion in which coloring agent particles are dispersed, and a release agent particle dispersion in which release agent particles are dispersed are prepared.

The resin particle dispersion is prepared by, for example, dispersing resin particles in a dispersion medium using a surfactant.

Examples of the dispersion medium used in the resin particle dispersion include aqueous media.

Examples of aqueous media include water such as distilled water and ion exchange water and alcohols. These aqueous media may be used alone or in combination of two or more.

Examples of the surfactant include anionic surfactants, such as sulfate surfactants, sulfonate surfactants, phosphate surfactants, and soap surfactants; cationic surfactants, such as amine salt surfactants and quaternary ammonium salt surfactants; and nonionic surfactants, such as polyethylene glycol surfactants, alkylphenol ethylene oxide adduct surfactants, and polyhydric alcohol surfactants. Among these surfactants, in particular, anionic surfactants and cationic surfactants may be used. A nonionic surfactant may be used in combination with an anionic surfactant or a cationic surfactant.

The surfactants may be used alone or in combination of two or more.

Examples of a method for dispersing resin particles in a dispersion medium to prepare the resin particle dispersion include ordinary dispersion methods using a rotary shear homogenizer, a ball mill having media, a sand mill, and Dyno-Mill. Depending on the type of resin particles, the resin particles may be dispersed in the dispersion medium by a phase-inversion emulsification method. The phase-inversion emulsification method is a method for dispersing a resin in the form of particles in an aqueous medium. This method involves dissolving a target resin in a hydrophobic organic solvent capable of dissolving the resin; adding a base to the organic continuous phase (O phase) to cause neutralization; and then adding an aqueous medium (W phase) to cause phase inversion from W/O to O/W.

The volume-average particle diameter of the resin particles dispersed in the resin particle dispersion is preferably 0.01 μm or more and 1 μm or less, more preferably 0.08 μm or more and 0.8 μm or less, and still more preferably 0.1 μm or more and 0.6 μm or less.

The volume-average particle diameter of the resin particles is determined as follows: drawing the volume-based cumulative distribution in divided particle diameter ranges (channels) from the smaller particle diameter side using the particle diameter distribution obtained by measurement with a laser diffraction particle diameter distribution measuring device (e.g., LA-700 available from Horiba Ltd.); and defining the particle diameter at a cumulative percentage of 50% relative to all particles as a volume-average particle diameter D50 v. The volume-average particle diameter of particles in other dispersions is determined similarly.

The amount of the resin particles in the resin particle dispersion is preferably 5 mass % or more and 50 mass % or less, and more preferably 10 mass % or more and 40 mass % or less.

Similarly to the resin particle dispersion, for example, the coloring agent particle dispersion and the release agent particle dispersion are also prepared. Specifically, the volume-average particle diameter of the particles, the dispersion medium, the dispersion method, and the amount of the particles for the resin particle dispersion are the same as those for the coloring agent particles dispersed in the coloring agent particle dispersion and the release agent particles dispersed in the release agent particle dispersion.

Aggregated Particle Forming Step

Next, the resin particle dispersion is mixed with the coloring agent particle dispersion and the release agent particle dispersion.

The resin particles, the coloring agent particles, and the release agent particles cause hetero-aggregation in the mixture dispersion to form aggregated particles having a diameter close to the intended toner particle diameter and containing the resin particles, the coloring agent particles, and the release agent particles.

Specifically, the aggregated particles are formed, for example, as follows: adding a flocculant to the mixture dispersion and adjusting the pH of the mixture dispersion to the acid side (e.g., pH 2 or higher and pH 5 or lower), and as necessary, adding a dispersion stabilizer; and then heating the mixture dispersion to a temperature close to the glass transition temperature of the resin particles (specifically, heating to, for example, the glass transition temperature of the resin particles minus 30° C. or higher and the glass transition temperature minus 10° C. or lower) to cause aggregation of the particles dispersed in the mixture dispersion.

The aggregated particle forming step may involve, for example, adding a flocculant to the mixture dispersion at room temperature (e.g., 25° C.) under stirring with a rotary shear homogenizer and adjusting the pH of the mixture dispersion to the acid side (e.g., pH 2 or higher and pH 5 or lower), and heating the mixture dispersion after addition of a dispersion stabilizer as necessary.

Examples of the flocculant include surfactants having polarity opposite to the polarity of the surfactant contained in the mixture dispersion, inorganic metal salts, and divalent or higher valent metal complexes. The use of a metal complex as a flocculant reduces the amount of the surfactant used and improves charging characteristics.

The flocculant may be used in combination with an additive that forms a complex or a similar bond with metal ions of the flocculant, as necessary. The additive may be a chelating agent.

Examples of inorganic metal salts include metal salts, such as calcium chloride, calcium nitrate, barium chloride, magnesium chloride, zinc chloride, aluminum chloride, and aluminum sulfate; and inorganic metal salt polymers, such as polyaluminum chloride, polyaluminum hydroxide, and calcium polysulfide.

The chelating agent may be a water-soluble chelating agent. Examples of the chelating agent include oxycarboxylic acids, such as tartaric acid, citric acid, and gluconic acid; and aminocarboxylic acids, such as iminodiacetic acid (IDA), nitrilotriacetic acid (NTA), and ethylenediaminetetraacetic acid (EDTA).

The amount of the chelating agent added is preferably 0.01 parts by mass or more and 5.0 parts by mass or less and more preferably 0.1 parts by mass or more and 3.0 parts by mass or less relative to 100 parts by mass of the resin particles.

Fusion-Coalescence Step

Next, the aggregated particle dispersion in which the aggregated particles are dispersed is heated to, for example, a temperature not lower than the glass transition temperature of the resin particles (e.g., a temperature higher than the glass transition temperature of the resin particles by 10° C. to 30° C.) to cause fusion and coalescence of the aggregated particles and thus to form toner particles.

The toner particles are produced through the above-described steps.

The toner particles may be manufactured through the following steps: a step of preparing an aggregated particle dispersion in which aggregated particles are dispersed, and then mixing the aggregated particle dispersion and a resin particle dispersion in which resin particles are dispersed, to cause aggregation such that the resin particles adhere to the surfaces of the aggregated particles and thus to form secondary aggregated particles; and a step of heating a secondary aggregated particle dispersion in which the secondary aggregated particles are dispersed, to cause fusion and coalescence of the secondary aggregated particles and thus to form toner particles having a core-shell structure.

After completion of the fusion-coalescence step, the toner particles formed in the dispersion are subjected to a known washing step, a known solid-liquid separation step, and a known drying step to provide dry toner particles. The washing step may involve sufficient displacement washing with ion exchange water in view of charging characteristics. The solid-liquid separation step may involve, for example, suction filtration or pressure filtration in view of productivity. The drying step may involve, for example, freeze drying, flush drying, fluidized bed drying, or vibratory fluidized bed drying in view of productivity.

The toner according to the exemplary embodiment is manufactured by, for example, adding external additives to the obtained dry toner particles and mixing them. Mixing may be performed with, for example, a V-blender, a Henschel mixer, or a Lodige mixer. In addition, coarse particles in the toner may be removed with, for example, a vibratory screening machine, a wind-power screening machine, as necessary.

Electrostatic Charge Image Developer

An electrostatic charge image developer according to an exemplary embodiment contains at least the toner according to the exemplary embodiment.

The electrostatic charge image developer according to the exemplary embodiment may be a one-component developer containing only the toner according to the exemplary embodiment, or may be a two-component developer formed by mixing the toner and a carrier.

The carrier is not limited, and may be any known carrier. Examples of the carrier include a coated carrier obtained by coating, with resin, the surfaces of cores formed of magnetic powder; a magnetic powder-dispersed carrier in which magnetic powder is dispersed in a matrix resin; and a resin-impregnated carrier in which porous magnetic powder is impregnated with resin. The magnetic powder-dispersed carrier and the resin-impregnated carrier may be carriers in which the surfaces of carrier-forming particles serving as cores are coated with resin.

Examples of the magnetic powder include powders made of magnetic metals, such as iron, nickel, and cobalt; and powders made of magnetic oxides, such as ferrite and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid ester copolymer, a straight silicone resin including an organosiloxane bond, and modified products thereof, fluorocarbon resin, polyester, polycarbonate, phenolic resin, and epoxy resin. The coating resin and the matrix resin may contain other additives, such as conductive particles. Examples of the conductive particles include particles made of metals, such as gold, silver, and copper; and particles made of carbon black, titanium oxide, zinc oxide, tin oxide, barium sulfate, aluminum borate, and potassium titanate.

To coat the surfaces of cores with resin, for example, a coating method using a coating-layer forming solution in which a coating resin and various additives (used as necessary) are dissolved in an appropriate solvent is used. The solvent is not limited and may be selected in consideration of the type of resin used, coating suitability, and the like.

Specific examples of the resin coating method include an immersion method that involves immersing cores in a coating-layer forming solution; a spray method that involves spraying a coating-layer forming solution onto the surfaces of cores; a fluidized bed method that involves spraying a coating-layer forming solution to cores while the cores are floating in air flow; and a kneader-coater method that involves mixing carrier cores and a coating-layer forming solution in a kneader-coater, and then removing a solvent.

The mixing ratio (mass ratio) of the toner to the carrier in the two-component developer is preferably from 1:100 to 30:100 (=toner:carrier), and more preferably from 3:100 to 20:100.

Image Forming Apparatus, Image Forming Method

An image forming apparatus and an image forming method according to exemplary embodiments will be described.

The image forming apparatus according to the exemplary embodiment includes: an image holding member; a charging unit that charges a surface of the image holding member; an electrostatic charge image forming unit that forms an electrostatic charge image on the charged surface of the image holding member; a developing unit that contains an electrostatic charge image developer and develops the electrostatic charge image on the surface of the image holding member by using the electrostatic charge image developer to form a toner image; an intermediate transfer body onto which the toner image on the surface of the image holding member is transferred; a first transfer unit that transfers the toner image on the surface of the image holding member onto the surface of the intermediate transfer body; a second transfer unit that transfers the toner image, which has been transferred onto the surface of the intermediate transfer body, onto the surface of a recording medium; a fixing unit that fixes the toner image that has been transferred onto the surface of the recording medium; and a cleaning unit that has a blade to be in contact with the surface of the intermediate transfer body and removes, by using the blade, toner remaining on the surface of the intermediate transfer body after the toner image has been transferred onto the surface of the recording medium. The electrostatic charge image developer according to the exemplary embodiment is used as an electrostatic charge image developer.

An image forming method (the image forming method according to the exemplary embodiment) is carried out in the image forming apparatus according to the exemplary embodiment. The image forming method includes: a charging step of charging the surface of the image holding member; an electrostatic charge image forming step of forming an electrostatic charge image on the charged surface of the image holding member; a developing step of developing the electrostatic charge image on the surface of the image holding member by using the electrostatic charge image developer according to the exemplary embodiment to form a toner image; a first transfer step of transferring the toner image on the surface of the image holding member onto the surface of the intermediate transfer body; a second transfer step of transferring the toner image, which has been transferred onto the surface of the intermediate transfer body, onto the surface of a recording medium; a fixing step of fixing the toner image that has been transferred onto the surface of the recording medium; and a cleaning step of removing toner remaining on the surface of the intermediate transfer body by bringing the blade into contact with the surface of the intermediate transfer body after the toner image has been transferred onto the surface of the recording medium.

The image forming apparatus according to the exemplary embodiment may be a known image forming apparatus, such as an apparatus including a cleaning unit that cleans the surface of an image holding member before charging after the first transfer, and an apparatus including a charge eliminating unit that eliminates charges by irradiating the surface of an image holding member with charge eliminating light before charging after the first transfer.

In the image forming apparatus according to the exemplary embodiment, for example, a section including the developing unit may have a cartridge structure (process cartridge) that is attachable to and detachable from the image forming apparatus. The process cartridge may be, for example, a process cartridge that contains the electrostatic charge image developer according to the exemplary embodiment and that includes the developing unit.

An example of the image forming apparatus according to the exemplary embodiment will be described below, but the image forming apparatus is not limited to this example. In the following description, the main parts shown in the figure are described, and the description of other parts is omitted.

FIG. 1 is a schematic structural view of the image forming apparatus according to the exemplary embodiment.

The image forming apparatus shown in FIG. 1 includes first to fourth electrophotographic image forming units 10Y, 10M, 10C, and 10K (image forming units), which respectively output yellow (Y), magenta (M), cyan (C), and black (K) color images based on color-separated image data. The image forming units (hereinafter may also be referred to simply as "units") 10Y, 10M, 10C, and 10K are arranged and spaced apart from each other at predetermined intervals in the horizontal direction. The units 10Y, 10M, 10C, and 10K may be process cartridges that are attachable to and detachable from the image forming apparatus.

An intermediate transfer belt (an example of the intermediate transfer body) 20 is located above and in upper parts of the units 10Y, 10M, 10C, and 10K. The intermediate transfer belt 20 extends so as to pass through the units 10Y, 10M, 10C, and 10K. The intermediate transfer belt 20 is wound around a drive roller 22 and a support roller 24 and runs in the direction from the first unit 10Y toward the fourth unit 10K. The support roller 24 undergoes a force in a direction away from the drive roller 22 by means of a spring or the like (not shown), so that tension is applied to the intermediate transfer belt 20 wound around both the support roller 24 and the drive roller 22. An intermediate transfer body cleaning device (an example of the intermediate transfer body cleaning unit) 30 is disposed adjacent to the image holding member-side surface of the intermediate transfer belt 20 so as to face the drive roller 22.

The intermediate transfer belt 20 is, for example, a multilayer body including a base layer and a surface layer on the outer circumferential surface of the base layer. The base layer contains, for example, a conductive agent and a resin, such as polyimide resin, polyamide resin, polyamide imide resin, polyether ester resin, polyarylate resin, and polyester resin. The surface layer contains, for example, at least one of the foregoing resins, a fluorocarbon resin, and a conductive agent. The thickness of the intermediate transfer belt 20 is, for example, 50 μm or more and 100 μm or less.

Yellow toner, magenta toner, cyan toner, and black toner respectively contained in toner cartridges 8Y, 8M, 8C, and 8K are respectively supplied to developing devices (examples of developing units) 4Y, 4M, 4C, and 4K of units 10Y, 10M, 10C, and 10K.

Since the first to fourth units 10Y, 10M, 10C, and 10K have the same structure and operate in the same manner, the first unit 10Y disposed upstream in the running direction of the intermediate transfer belt to form a yellow image will be described as a representative example.

The first unit 10Y has a photoreceptor 1Y, which functions as an image holding member. The photoreceptor 1Y is surrounded by, in sequence, a charging roller (an example of the charging unit) 2Y, which charges the surface of the photoreceptor 1Y to a predetermined potential, an exposure device (an example of the electrostatic charge image forming unit) 3, which exposes the charged surface to a laser beam 3Y based on a color-separated image signal to form an electrostatic charge image, a developing device (an example of the developing unit) 4Y, which supplies charged toner to the electrostatic charge image to develop the electrostatic charge image, a first transfer roller 5Y (an example of the first transfer unit), which transfers the developed toner image onto the intermediate transfer belt 20, and a photoreceptor cleaning device (an example of the cleaning unit) 6Y, which removes toner remaining on the surface of the photoreceptor 1Y after the first transfer.

The first transfer roller 5Y is disposed on the inner side of the intermediate transfer belt 20 so as to face the photoreceptor 1Y. The first transfer rollers 5Y, 5M, 5C, and 5K in the units are connected to the respective bias power supplies (not shown) that apply a first transfer bias. The transfer bias applied by each bias power supply to the corresponding first transfer roller changes under the control of a controller (not shown).

The photoreceptor cleaning device 6Y has a cleaning blade to be in contact with the surface of the photoreceptor 1Y. The cleaning blade comes into contact with the surface of the photoreceptor 1Y, which continues to rotate even after the toner image has been transferred onto the intermediate transfer belt 20, and removes toner remaining on the surface of the photoreceptor 1Y.

A second transfer roller (an example of the second transfer unit) 26 and the support roller 24 are disposed downstream of the fourth unit 10K. The second transfer roller 26 is disposed adjacent to the image holding surface of the intermediate transfer belt 20. The support roller 24 is disposed in contact with the inner surface of the intermediate transfer belt 20. The second transfer roller 26 and the support roller 24 form a second transfer section.

An intermediate transfer body cleaning device 30 has a cleaning blade to be in contact with the surface of the intermediate transfer belt 20. The cleaning blade comes into contact with the surface of the intermediate transfer belt 20, which continues to run even after the toner image has been transferred onto a recording medium, and removes toner remaining on the surface of the intermediate transfer belt 20. Examples of the material of the cleaning blade include thermosetting polyurethane rubber, silicone rubber, fluorocarbon rubber, and ethylene propylene diene rubber. The thickness of the cleaning blade is, for example, 1 mm or more and 7 mm or less.

The operation of the first unit 10Y in forming a yellow image will be described below.

Before operation, the charging roller 2Y charges the surface of the photoreceptor 1Y to a potential of −600 V to −800 V.

The photoreceptor 1Y includes a conductive substrate (e.g., a volume resistivity of $1\times10^{-6}$ Ωcm or less at 20° C.) and a photosensitive layer stacked on the substrate. The photosensitive layer normally has high resistance (comparable to the resistance of common resins), but irradiation with a laser beam changes the specific resistance of a region of the photosensitive layer irradiated with the laser beam. For this, the charged surface of the photoreceptor 1Y is irradiated with the laser beam 3Y from the exposure device 3 in accordance with yellow image data sent from the controller (not shown). As a result, an electrostatic charge image with a yellow image pattern is formed on the surface of the photoreceptor 1Y.

The electrostatic charge image is an image formed on the surface of the photoreceptor 1Y by means of charging. Specifically, the electrostatic charge image is so-called a negative latent image formed such that the specific resistance of a region of the photosensitive layer irradiated with the laser beam 3Y drops to cause flow of charges on the surface of the photoreceptor 1Y while charges in a region that is not irradiated with the laser beam 3Y remain.

The electrostatic charge image formed on the photoreceptor 1Y rotates up to a predetermined developing position as the photoreceptor 1Y runs. At this developing position, the electrostatic charge image on the photoreceptor 1Y is developed and visualized by the developing device 4Y to form a toner image.

The developing device 4Y contains, for example, an electrostatic charge image developer containing at least yellow toner and a carrier. The yellow toner is triboelectrically charged upon being stirred inside the developing device 4Y so as to have charges with the same polarity (negative polarity) as charges on the photoreceptor 1Y. The yellow toner is held on a developer roller (an example of a developer holding member). As the surface of the photoreceptor 1Y passes through the developing device 4Y, the yellow toner electrostatically adheres to charge-eliminated latent image areas on the surface of the photoreceptor 1Y, whereby the latent image is developed with the yellow toner. The photoreceptor 1Y having the yellow toner image formed thereon subsequently runs at a predetermined rate, and the toner image developed on the photoreceptor 1Y is transported to a predetermined first transfer position.

When the yellow toner image on the photoreceptor 1Y is transported to the first transfer position, a first transfer bias is applied to the first transfer roller 5Y, an electrostatic force from the photoreceptor 1Y toward the first transfer roller 5Y acts on the toner image, and the toner image on the photoreceptor 1Y is transferred onto the intermediate transfer belt 20. The transfer bias applied at this time has polarity (+) opposite to the polarity (−) of the toner. The transfer bias is controlled at, for example, +10 Å in the first unit 10Y by the controller (not shown).

The photoreceptor 1Y after the toner image has been transferred onto the intermediate transfer belt 20 continues to rotate and comes into contact with the cleaning blade of the photoreceptor cleaning device 6Y. The toner remaining on the photoreceptor 1Y is removed and collected by the photoreceptor cleaning device 6Y.

The first transfer biases applied to the first transfer rollers 5M, 5C, and 5K in the second unit 10M and the subsequent units are also controlled in the same manner as in the first unit.

Accordingly, the intermediate transfer belt 20 onto which the yellow toner image has been transferred in the first unit 10Y is transported through the second to fourth units 10M, 10C, and 10K, and the toner images of respective colors are multiply transferred in a superimposed manner.

The intermediate transfer belt 20 onto which the four color toner images have been multiply transferred through the first to fourth units reaches a second transfer section. The second transfer section includes the intermediate transfer belt 20, the support roller 24 in contact with the inner surface of the intermediate transfer belt, and a second transfer roller 26 disposed adjacent to the image holding surface of the intermediate transfer belt 20. A sheet of recording paper (an example of the recording medium) P is fed to a gap between the second transfer roller 26 and the intermediate transfer belt 20 through a feeding mechanism at a predetermined timing, and a second transfer bias is applied to the support roller 24. The transfer bias applied at this time has the same polarity (−) as the polarity (−) of the toner. An electrostatic force from the intermediate transfer belt 20 toward the sheet of recording paper P acts on the toner image, whereby the toner image on the intermediate transfer belt 20 is transferred onto the sheet of recording paper P. The second transfer bias in this case is determined on the basis of the resistance detected by a resistance detector (not shown) that detects the resistance of the second transfer section. The voltage for the second transfer bias is controlled.

The intermediate transfer belt 20 after the toner image has been transferred onto the sheet of recording paper P continues to run and comes into contact with the cleaning blade of the intermediate transfer body cleaning device 30. The toner remaining on the intermediate transfer belt 20 is removed and collected by the intermediate transfer body cleaning device 30. The contact pressure of the cleaning blade (the pressure applied to the intermediate transfer belt 20 in the thickness direction) is, for example, 1 g/mm or more and 5 g/mm or less. The contact angle of the cleaning blade is, for example, 5 degrees or more and 30 degrees or less. The contact width of the cleaning blade is, for example, 0.1 mm or more and 2 mm or less.

The sheet of recording paper P onto which the toner image has been transferred is conveyed to a pressure contact section (nip section) between a pair of fixing rollers in a fixing device (an example of the fixing unit) 28. The toner image is thus fixed to the sheet of recording paper P to form a fixed image.

Examples of the recording paper P onto which a toner image is transferred include plain paper used in electrophotographic copiers, printers, and the like. Examples of the recording medium include OHP sheets, in addition to the recording paper P.

To improve the smoothness of the image surface after fixing, the recording paper P may have a smooth surface and may be, for example, coated paper obtained by coating the surface of plain paper with resin or the like, art paper for printing, or the like.

The sheet of recording paper P to which the color image has been fixed is discharged to a discharge section, and a series of color image forming operations are completed.

Process Cartridge, Toner Cartridge

A process cartridge according to an exemplary embodiment will be described.

The process cartridge according to the exemplary embodiment includes: a developing unit that contains the electrostatic charge image developer according to the exemplary embodiment and develops an electrostatic charge image on the surface of an image holding member by using the electrostatic charge image developer to form a toner image; an intermediate transfer body onto which the toner image on the surface of the image holding member is transferred; and a cleaning unit that has a blade to be in contact with the surface of the intermediate transfer body and removes, by using the blade, toner remaining on the surface of the intermediate transfer body after the toner image has been transferred onto the surface of a recording medium. The process cartridge according to the exemplary embodiment is attachable to and detachable from an image forming apparatus.

The process cartridge according to the exemplary embodiment is not limited to the foregoing configuration, and may further include, for example, at least one selected from other units, such as an image holding member, a charging unit, and an electrostatic charge image forming unit.

An example of the process cartridge according to the exemplary embodiment will be described below, but the process cartridge is not limited to this example. In the following description, the main parts shown in the figure are described, and the description of other parts is omitted.

Figure 2:
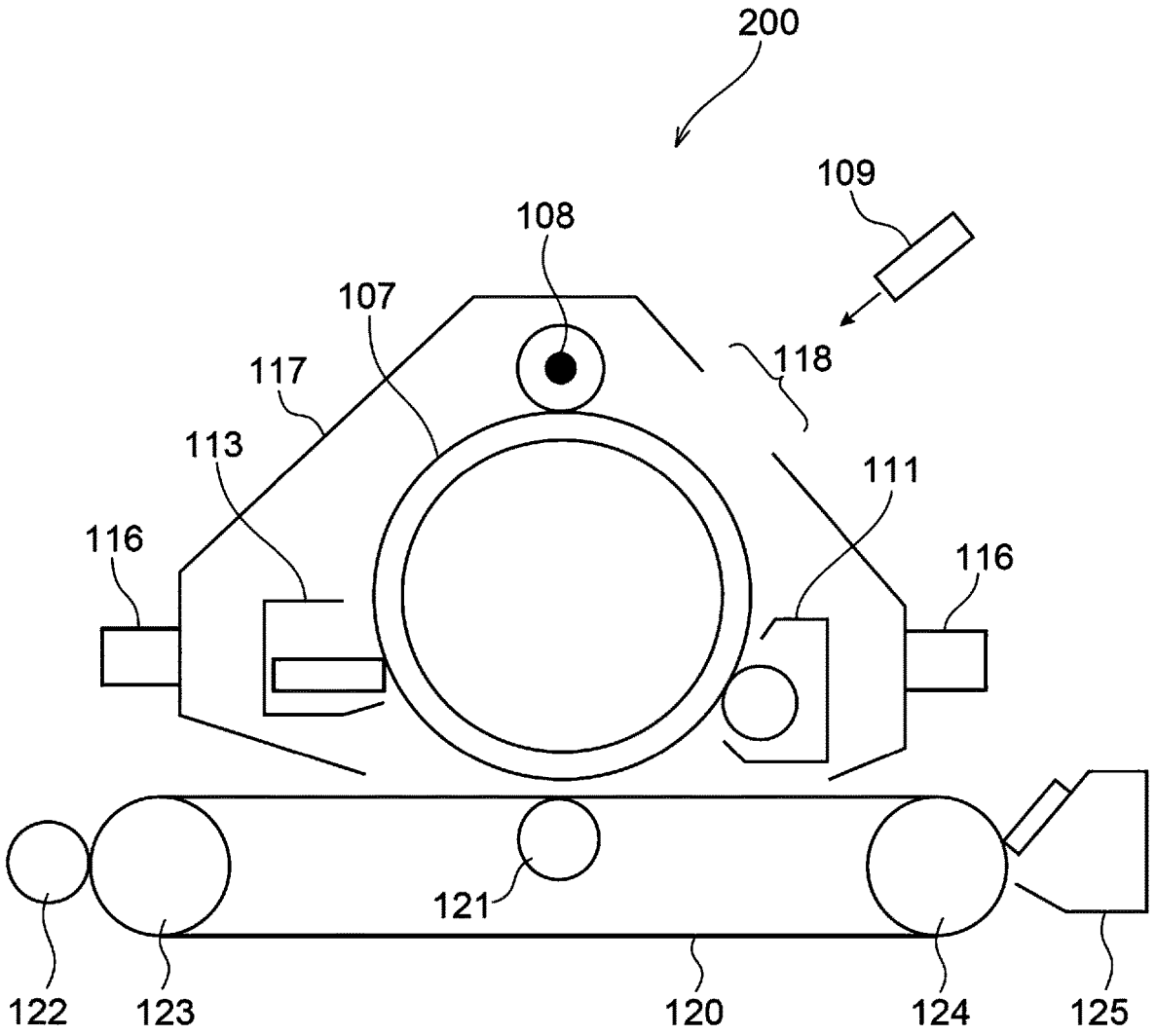
FIG. 2 is a schematic structural view of an example of a process cartridge attachable to and detachable from the image forming apparatus according the exemplary embodiment.

FIG. 2 is a schematic structural view of an example of a process cartridge attachable to and detachable from the image forming apparatus according the exemplary embodiment. In a process cartridge 200 shown in FIG. 2, a photoreceptor 107 (an example of the image holding member) is integral with a charging roller 108 (an example of the charging unit), a developing device 111 (an example of the developing unit), and a photoreceptor cleaning device 113 (an example of the image holding member cleaning unit), which are disposed around the photoreceptor 107, by means of a housing 117 having an installation rail 116 and an opening 118 for exposure. The process cartridge 200 further includes an intermediate transfer belt 120 (an example of the intermediate transfer body), a first transfer roller 121 (an example of the first transfer unit), a second transfer roller 122 (an example of the second transfer unit), a support roller 123, a drive roller 124, and an intermediate transfer body cleaning device 125 (an example of the intermediate transfer body cleaning unit). The photoreceptor cleaning device 113 has a blade to be in contact with the photoreceptor 107. The intermediate transfer body cleaning device 125 has a blade to be in contact with the intermediate transfer belt 120. The photoreceptor 107, when disposed in an image forming apparatus to form an image, is exposed to light by using an exposure device 109 (an example of the electrostatic charge image forming unit), whereby an electrostatic charge image is formed on the surface of the photoreceptor 107.

Next, a toner cartridge according to an exemplary embodiment will be described.

The toner cartridge according to the exemplary embodiment contains the toner according to the exemplary embodiment. The toner cartridge is attachable to and detachable from an image forming apparatus. The toner cartridge contains toner for replenishment to be supplied to the developing unit in the image forming apparatus.

The image forming apparatus shown in FIG. 1 includes detachable toner cartridges 8Y, 8M, 8C, and 8K. The developing devices 4Y, 4M, 4C, and 4K are connected to the respective toner cartridges corresponding to the developing devices (colors) through toner supply pipes (not shown). When the toner contained in the toner cartridges runs short, these toner cartridges are replaced.

EXAMPLES

Exemplary embodiments of the present disclosure will be described below in detail by way of Examples, but exemplary embodiments of the present disclosure are not limited to these Examples. In the following description, the units "part" and "%" are on a mass basis, unless otherwise specified.

Preparation of Toner Particles (1)

Preparation of Amorphous Polyester Resin Dispersion (A1)

Terephthalic acid: 70 parts

Fumaric acid: 30 parts

Ethylene glycol: 44 parts 1,5-Pentanediol: 46 parts

These materials are placed in a flask equipped with a stirrer, a nitrogen inlet tube, a temperature sensor, and a fractionating column. The mixture is heated to 210° C. over 1 hour under nitrogen gas flow. Titanium tetrabutoxide is added in an amount of 1 part per 100 parts of the total of the above materials. While generated water is distilled off, the mixture is heated to 240° C. over 0.5 hours, and the dehydration condensation reaction continues at 240° C. for 1 hour. The reaction product is then cooled. An amorphous polyester resin having a weight-average molecular weight of 94500 and a glass transition temperature of 61° C. is produced accordingly.

In a container equipped with a temperature controlling unit and a nitrogen purging unit, 40 parts of ethyl acetate and 25 parts of 2-butanol are placed to form a solvent mixture. The amorphous polyester resin (100 parts) is gradually added to and dissolved in the solvent mixture. To the obtained solution, a 10% aqueous ammonia solution (in an amount corresponding to three times the acid value of the resin by molar ratio) is added, and the mixture is stirred for 30 minutes. Next, the container is purged with dry nitrogen and held at 40° C. To the mixture, 400 parts of ion exchange water is added dropwise under stirring to cause emulsification. After completion of dropwise addition, the emulsion is returned to 25° C. A resin particle dispersion in which resin particles having a volume-average particle diameter of 210 nm are dispersed is obtained accordingly. The solids content of the resin particle dispersion is adjusted to 20% by addition of ion exchange water to provide an amorphous polyester resin dispersion (A1).

Preparation of Crystalline Polyester Resin Dispersion (B1)

Dimethyl sebacate: 97 parts

Sodium dimethyl 5-sulphonatoisophthalate: 3 parts

Ethylene glycol: 100 parts

Dibutyltin oxide (catalyst): 0.3 parts

These materials are placed in a heat-dried three-necked flask, and the air in the three-necked flask is converted into an inert atmosphere by replacement with nitrogen gas. The mixture is stirred and refluxed at 180° C. for 5 hours by machinery stirring. Next, the mixture is then gradually heated to 240° C. under reduced pressure and stirred for 2 hours. The mixture is then air-cooled to terminate the reaction when the mixture becomes viscous. A crystalline polyester resin having a weight-average molecular weight of 9700 and a melting temperature of 84° C. is produced accordingly.

A mixture of 90 parts of the crystalline polyester resin, 1.8 parts of an anionic surfactant (Neogen RK available from DKS Co. Ltd.), and 210 parts of ion exchange water is heated to 100° C. The mixture is formed into a dispersion by using a homogenizer (ULTRA-TURRAX T50 available from IKA) and then subjected to a dispersion treatment with a pressure discharge Gaulin homogenizer for 1 hour to form a resin particle dispersion in which resin particles having a volume-average particle diameter of 205 nm are dispersed. The solids content of the resin particle dispersion is adjusted to 20% by addition of ion exchange water to provide a crystalline polyester resin dispersion (B1).

Preparation of Release Agent Particle Dispersion (W1)

Paraffin wax (HNP-9 available from Nippon Seiro Co., Ltd.): 100 parts

Anionic surfactant (Neogen RK available from DKS Co. Ltd.): 1 part

Ion exchange water: 350 parts

These materials are mixed and heated to 100° C. The mixture is formed into a dispersion by using a homogenizer (ULTRA-TURRAX T50 available from IKA) and then subjected to a dispersion treatment with a pressure discharge Gaulin homogenizer to form a release agent particle dispersion in which release agent particles having a volume-average particle diameter of 200 nm are dispersed. The solids content of the release agent particle dispersion is adjusted to 20% by addition of ion exchange water to form a release agent particle dispersion (W1).

Preparation of Coloring Agent Particle Dispersion (K1)

Carbon black (Regal 330 available from Cabot Corporation): 50 parts

Ionic surfactant Neogen RK (available from DKS Co. Ltd.): 5 parts

Ion exchange water: 195 parts

These materials are mixed and subjected to a dispersion treatment by using Ultimizer (available from Sugino Machine Limited) at 240 MPa for 10 minutes to form a coloring agent particle dispersion (K1) with 20% solids content.

Preparation of Toner Particles

Ion exchange water: 200 parts

Amorphous polyester resin dispersion (A1): 150 parts

Crystalline polyester resin dispersion (B1): 10 parts

Release agent particle dispersion (W1): 10 parts

Coloring agent particle dispersion (K1): 15 parts

Anionic surfactant (TaycaPower): 2.8 parts

These materials are placed in a round stainless steel flask. The pH of the mixture is adjusted to 3.5 by addition of 0.1N nitric acid, and a polyaluminum chloride aqueous solution of 2 parts of polyaluminum chloride (available from Oji Paper Co., Ltd., 30% powder product) in 30 parts of ion exchange water is then added. The mixture is formed into a dispersion at 30° C. by using a homogenizer (ULTRA-TURRAX T50 available from IKA), and the dispersion is then heated to 45° C. in a heating oil bath and held until the volume-average particle diameter reaches 4.9 μm. Next, 60 parts of the amorphous polyester resin dispersion (A1) is added and the mixture is held for 30 minutes. Next, 60 parts of the amorphous polyester resin dispersion (A1) is further added when the volume-average particle diameter reaches 5.2 μm, and the mixture is held for 30 minutes. Subsequently, 20 parts of 10% nitrilotriacetic acid (NTA) metal salt aqueous solution (Chelest 70 available from Chelest Corporation) is added, and the pH of the mixture is then adjusted to 9.0 by addition of 1N sodium hydroxide aqueous solution. Next, 1 part of anionic surfactant (TaycaPower) is added, and the mixture is heated to 85° C. under stirring and held for 5 hours. Subsequently, the mixture is cooled to 20° C. at a rate of 20° C./min. Next, the mixture is filtered, washed well with ion exchange water, and dried to form toner particles (1) having a volume-average particle diameter of 5.7 μm.

Preparation of Toner Particles (2) to (5)

Toner particles (2) to (5) having different volume-average particle diameters are produced in the same manner as in the manufacture of the toner particles (1) except that the holding time in the fusion-coalescence step is changed.

Toner particles (2): volume-average particle diameter 13.0 μm

Toner particles (3): volume-average particle diameter 2.8 μm

Toner particles (4): volume-average particle diameter 9.8 μm

Toner particles (5): volume-average particle diameter 3.0 μm

Preparation of Melamine Cyanurate Particles (1) to (11)

The following melamine cyanurate particles (1) to (11) are prepared. In Table 1, "MC" denotes melamine cyanurate.

Melamine cyanurate particles (1): crystallite diameter 130 Å, number-average particle diameter 0.8 μm Melamine cyanurate particles (2): crystallite diameter 260 Å, number-average particle diameter 0.9 μm Melamine cyanurate particles (3): crystallite diameter 190 Å, number-average particle diameter 0.2 μm Melamine cyanurate particles (4): crystallite diameter 190 Å, number-average particle diameter 2.4 μm Melamine cyanurate particles (5): crystallite diameter 190 Å, number-average particle diameter 0.3 μm Melamine cyanurate particles (6): crystallite diameter 190 Å, number-average particle diameter 2.5 μm Melamine cyanurate particles (7): crystallite diameter 190 Å, number-average particle diameter 0.8 μm Melamine cyanurate particles (8): crystallite diameter 240 Å, number-average particle diameter 0.3 μm Melamine cyanurate particles (9): crystallite diameter 160 Å, number-average particle diameter 0.3 μm Melamine cyanurate particles (10): crystallite diameter 240 Å, number-average particle diameter 1.9 μm Melamine cyanurate particles (11): crystallite diameter 160 Å, number-average particle diameter 1.9 μm Preparation of Carrier After 500 parts of spherical magnetite powder particles (volume-average particle diameter 0.55 μm) are stirred with a Henschel mixer, 5 parts of titanate coupling agent is added, and the mixture is heated to 100° C. and stirred for 30 minutes. Next, 6.25 parts of phenol, 9.25 parts of 35% formalin, 500 parts of titanate coupling agent-treated magnetite particles, 6.25 parts of 25% ammonia water, and 425 parts of water are placed in a four-necked flask and stirred. The mixture is caused to react under stirring at 85° C. for 120 minutes and then cooled to 25° C. After addition of 500 parts of water, the supernatant is removed, and the precipitate is washed with water. The water-washed precipitate is heat-dried under reduced pressure to provide a carrier having an average particle diameter of 35 μm.

Example 1

In a sample mill, 100 parts of toner particles (1), 1.6 parts of hexamethyldisilazane-hydrophobized silica particles (RX200 available from Nippon Aerosil Co., Ltd.), and melamine cyanurate particles (1) in the amount (mass %) described in Table 1 are placed and mixed at 10000 rpm for 30 seconds. The mixture is then screened through a vibrating screen with a mesh size of 45 μm to prepare a toner having a volume-average particle diameter of 5.7 μm.

The toner and the carrier are placed in a V-blender at a ratio of toner:carrier=5:95 (mass ratio) and stirred for 20 minutes to provide a developer.

Examples 2 to 5, Comparative Examples 1 to 6

Toners and developers are produced in the same manner as in Example 1 except that the type of toner particles or the type of layered-structure compound particles and the addition amount are changed.

Performance Evaluation

A modified machine of an image forming apparatus (700 Digital Color Press) available from Fuji Xerox Co., Ltd. is loaded with a developer and placed in a room at a temperature of 10° C. and a relative humidity of 15% for one day to control temperature and humidity. In an environment at a temperature of 10° C. and a relative humidity of 15%, an image with 30% area coverage is output onto 100,000 sheets of A4 size paper, and an image chart having a combination of a solid image and a halftone image with a toner loading amount of 0.1 mg/cm$^2$ is then output onto 500 sheets of A4 size paper. The 10th sheet, 50th sheet, 100th sheet, and 500th sheet of A4 size paper are visually observed, and the total number of color streaks generated in the halftone image is categorized as described below.

G1: no color streak

G2: 1 to 5 color streaks

G3: 6 to 10 color streaks

G4: 11 or more color streaks, unacceptable for practical use.

TABLE 1

| | Toner Particles | | Layered-Structure Compound Particles | | | | | | Performance Evaluation | |
|---|---|---|---|---|---|---|---|---|---|---|
| | No. | Volume-Average Particle Diameter Dv (μm) | No. | Compound | Crystallite Diameter (A) | Number-Average Particle Diameter Dn (μm) | Amount (mass %) Relative to Entire Toner | Particle Diameter Ratio Dn/Dv | Number of Generated Color Streaks | Category |
| Comparative Example 1 | (1) | 5.7 | (1) | MC | 130 | 0.8 | 0.3 | 0.14 | 18 | G4 |
| Comparative Example 2 | (1) | 5.7 | (2) | MC | 260 | 0.9 | 0.3 | 0.16 | 12 | G4 |
| Comparative Example 3 | (1) | 5.7 | (3) | MC | 190 | 0.2 | 0.3 | 0.04 | 15 | G4 |
| Comparative Example 4 | (1) | 5.7 | (4) | MC | 190 | 2.4 | 0.3 | 0.42 | 18 | G4 |
| Comparative Example 5 | (2) | 13.0 | (5) | MC | 190 | 0.3 | 0.3 | 0.02 | 14 | G4 |
| Comparative Example 6 | (3) | 2.8 | (6) | MC | 190 | 2.5 | 0.3 | 0.89 | 17 | G4 |
| Example 1 | (1) | 5.7 | (7) | MC | 190 | 0.8 | 0.3 | 0.14 | 0 | G1 |
| Example 2 | (4) | 9.8 | (8) | MC | 240 | 0.3 | 0.3 | 0.03 | 2 | G2 |
| Example 3 | (4) | 9.8 | (9) | MC | 160 | 0.3 | 0.3 | 0.03 | 7 | G3 |

TABLE 1-continued

| | Toner Particles | | Layered-Structure Compound Particles | | | | | | Performance Evaluation | |
|---|---|---|---|---|---|---|---|---|---|---|
| | No. | Volume-Average Particle Diameter Dv (μm) | No. | Compound | Crystallite Diameter (A) | Number-Average Particle Diameter Dn (μm) | Amount (mass %) Relative to Entire Toner | Particle Diameter Ratio Dn/Dv | Number of Generated Color Streaks | Category |
| Example 4 | (5) | 3.0 | (10) | MC | 240 | 1.9 | 0.3 | 0.63 | 4 | G2 |
| Example 5 | (5) | 3.0 | (11) | MC | 160 | 1.9 | 0.3 | 0.63 | 9 | G3 |

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An electrostatic charge image development toner comprising:

toner particles; and layered-structure compound particles, wherein the layered-structure compound particles contain melamine cyanurate particles, have a crystallite diameter of 150 Å or more and 250 Å or less as calculated from a maximum peak width in a Cu Kα X-ray diffraction chart and have a number-average particle diameter Dn of 0.3 μm or more and 2.0 μm or less, and a ratio Dn/Dv of a number-average particle diameter Dn of the layered-structure compound particles to a volume-average particle diameter Dv of the toner particles is 0.03 or more and 0.7 or less.

2. The electrostatic charge image development toner according to claim 1, wherein an amount of the layered-structure compound particles is 0.1 mass % or more and 2.0 mass % or less relative to the entire electrostatic charge image development toner.

3. The electrostatic charge image development toner according to claim 2, wherein the amount of the layered-structure compound particles is 0.1 mass % or more and 1.0 mass % or less relative to the entire electrostatic charge image development toner.

4. The electrostatic charge image development toner according to claim 3, wherein the crystallite diameter of the layered-structure compound particles is 160 Å or more and 250 Å or less.

5. The electrostatic charge image development toner according to claim 3, wherein the number-average particle diameter Dn of the layered-structure compound particles is 0.3 μm or more and 1.8 μm or less.

6. The electrostatic charge image development toner according to claim 2, wherein the crystallite diameter of the layered-structure compound particles is 160 Å or more and 250 Å or less.

7. The electrostatic charge image development toner according to claim 6, wherein the number-average particle diameter Dn of the layered-structure compound particles is 0.3 μm or more and 1.8 μm or less.

8. The electrostatic charge image development toner according to claim 2, wherein the number-average particle diameter Dn of the layered-structure compound particles is 0.3 μm or more and 1.8 μm or less.

9. The electrostatic charge image development toner according to claim 1, wherein the crystallite diameter of the layered-structure compound particles is 160 Å or more and 250 Å or less.

10. The electrostatic charge image development toner according to claim 9, wherein the number-average particle diameter Dn of the layered-structure compound particles is 0.3 μm or more and 1.8 μm or less.

11. The electrostatic charge image development toner according to claim 1, wherein the number-average particle diameter Dn of the layered-structure compound particles is 0.3 μm or more and 1.8 μm or less.

12. The electrostatic charge image development toner according to claim 1, wherein the ratio Dn/Dv of the number-average particle diameter Dn of the layered-structure compound particles to the volume-average particle diameter Dv of the toner particles is 0.05 or more and 0.6 or less.

13. The electrostatic charge image development toner according to claim 1, wherein the volume-average particle diameter Dv of the toner particles is 3.0 μm or more and 10.0 μm or less.

14. The electrostatic charge image development toner according to claim 13, wherein the volume-average particle diameter Dv of the toner particles is 3.5 μm or more and 7.0 μm or less.

15. An electrostatic charge image developer comprising the electrostatic charge image development toner according to claim 1.

16. A process cartridge attachable to and detachable from an image forming apparatus, the process cartridge comprising:

a developing unit that contains the electrostatic charge image developer according to claim 15 and develops an electrostatic charge image on a surface of an image holding member by using the electrostatic charge image developer to form a toner image;

an intermediate transfer body onto which the toner image on the surface of the image holding member is transferred; and a cleaning unit that has a blade to be in contact with a surface of the intermediate transfer body and removes, by using the blade, toner remaining on the surface of the intermediate transfer body after the toner image has been transferred onto a surface of a recording medium.

17. An image forming apparatus comprising:

an image holding member;

a charging unit that charges a surface of the image holding member;

an electrostatic charge image forming unit that forms an electrostatic charge image on the charged surface of the image holding member;

a developing unit that contains the electrostatic charge image developer according to claim 15 and develops the electrostatic charge image on the surface of the image holding member by using the electrostatic charge image developer to form a toner image;

an intermediate transfer body onto which the toner image on the surface of the image holding member is transferred;

a first transfer unit that transfers the toner image on the surface of the image holding member onto a surface of the intermediate transfer body;

a second transfer unit that transfers the toner image, which has been transferred onto the surface of the intermediate transfer body, onto a surface of a recording medium;

a fixing unit that fixes the toner image that has been transferred onto the surface of the recording medium; and a cleaning unit that has a blade to be in contact with the surface of the intermediate transfer body and removes, by using the blade, toner remaining on the surface of the intermediate transfer body after the toner image has been transferred onto the surface of the recording medium.

18. An image forming method comprising:

charging a surface of an image holding member;

forming an electrostatic charge image on the charged surface of the image holding member;

developing the electrostatic charge image on the surface of the image holding member by using the electrostatic charge image developer according to claim 16 to form a toner image;

transferring the toner image on the surface of the image holding member onto a surface of an intermediate transfer body;

transferring the toner image, which has been transferred onto the surface of the intermediate transfer body, onto a surface of a recording medium;

fixing the toner image that has been transferred onto the surface of the recording medium; and removing toner remaining on the surface of the intermediate transfer body by bringing a blade into contact with the surface of the intermediate transfer body after the toner image has been transferred onto the surface of the recording medium.

19. A toner cartridge attachable to and detachable from an image forming apparatus, the toner cartridge comprising the electrostatic charge image development toner according to claim 1.

* * * * *